US011603734B2

(12) United States Patent
Yue et al.

(10) Patent No.: US 11,603,734 B2
(45) Date of Patent: Mar. 14, 2023

(54) MECHANICAL SUPPORT RING FOR ELASTOMER SEAL

(71) Applicant: CNPC USA Corporation, Houston, TX (US)

(72) Inventors: Jianpeng Yue, Sugar Land, TX (US); Matthew Patsy, Houston, TX (US); Anthony Tran, Kemah, TX (US); Jianhui Xu, Katy, TX (US); Peng Cheng, Sugar Land, TX (US)

(73) Assignee: CNPC USA Corporation, Houston, TX (US)

( * ) Notice: Subject to any disclaimer, the term of this patent is extended or adjusted under 35 U.S.C. 154(b) by 330 days.

(21) Appl. No.: 15/778,928

(22) PCT Filed: Nov. 22, 2016

(86) PCT No.: PCT/US2016/063363

§ 371 (c)(1),
(2) Date: May 24, 2018

(87) PCT Pub. No.: WO2017/091589

PCT Pub. Date: Jun. 1, 2017

(65) Prior Publication Data

US 2018/0334879 A1 Nov. 22, 2018

Related U.S. Application Data

(60) Provisional application No. 62/259,608, filed on Nov. 24, 2015.

(51) Int. Cl.

| | |
|---|---|
| ***E21B 33/129*** | (2006.01) |
| ***E21B 33/128*** | (2006.01) |
| ***E21B 33/12*** | (2006.01) |

(52) U.S. Cl.
CPC ..... *E21B 33/1293* (2013.01); *E21B 33/1208* (2013.01); *E21B 33/128* (2013.01)

(58) Field of Classification Search
CPC . E21B 33/1293; E21B 33/1208; E21B 33/128
See application file for complete search history.

(56) References Cited

U.S. PATENT DOCUMENTS 3,586,106 A * 6/1971 Conrad ..... E21B 33/1294 166/120
4,697,640 A * 10/1987 Szarka ..... E21B 33/1295 166/120

(Continued)

FOREIGN PATENT DOCUMENTS

EP 1408195 A1 * 4/2004 ..... E21B 33/1208
WO 200814088 A1 11/2008

OTHER PUBLICATIONS

International Preliminary Report on Patentability dated Jun. 7, 2018, in International Application No. PCT/US16/63363.

(Continued)

*Primary Examiner* — Robert E Fuller
*Assistant Examiner* — Neel Girish Patel
(74) *Attorney, Agent, or Firm* — Craft Chu PLLC; Andrew W. Chu

(57) ABSTRACT

A support ring prevents an elastomer seal from extruding. The support ring is expanded and supports the expanded seal, preventing the elastomer seal failing due to extrusion.

16 Claims, 16 Drawing Sheets

(56) References Cited

U.S. PATENT DOCUMENTS 5,271,468 A * 12/1993 Streich ..... E21B 33/1204 166/387
5,701,959 A * 12/1997 Hushbeck ..... E21B 33/1216 166/118
5,857,520 A * 1/1999 Mullen ..... E21B 33/1216 166/196
6,267,383 B1 7/2001 Morvant
7,921,921 B2 4/2011 Bishop et al.
8,205,671 B1 * 6/2012 Branton ..... E21B 33/1216 166/118
2002/0043368 A1 * 4/2002 Bell ..... E21B 33/1216 166/118
2002/0070503 A1 * 6/2002 Zimmerman ..... E21B 33/1216 277/337
2003/0000710 A1 * 1/2003 Turley ..... E21B 33/1208 166/386
2004/0036225 A1 * 2/2004 Ritter ..... E21B 33/1208 277/328
2005/0173126 A1 8/2005 Starr et al.
2006/0289173 A1 * 12/2006 Conaway ..... E21B 33/1216 166/387
2008/0190600 A1 * 8/2008 Shkurti ..... E21B 33/134 166/134
2008/0223588 A1 * 9/2008 Marshall ..... E21B 33/1208 166/387
2009/0255690 A1 * 10/2009 Conner ..... E21B 33/1216 166/387
2010/0294483 A1 11/2010 Turley et al.
2011/0061857 A1 * 3/2011 White ..... E21B 33/1216 166/196
2012/0061105 A1 * 3/2012 Neer ..... E21B 33/1216 166/387
2012/0133098 A1 * 5/2012 Farquhar ..... E21B 33/1216 277/314
2013/0180705 A1 7/2013 Fuglestad
2013/0192853 A1 * 8/2013 Themig ..... E21B 33/1216 166/387
2013/0306330 A1 * 11/2013 Bishop ..... E21B 33/128 166/387
2013/0306331 A1 * 11/2013 Bishop ..... E21B 33/128 166/387
2014/0190685 A1 * 7/2014 Frazier ..... E21B 33/1293 166/250.01
2015/0060088 A1 * 3/2015 Goodman ..... E21B 33/1208 166/387
2015/0267499 A1 * 9/2015 Fleetwood ..... E21B 17/046 166/179
2016/0061000 A1 * 3/2016 Rochen ..... B29C 45/14 166/138
2016/0138362 A1 * 5/2016 Dockweiler ..... E21B 33/1216 166/138

OTHER PUBLICATIONS

International Search Report and Written Opinion dated Mar. 6, 2017, in International Application No. PCT/US16/63363.

* cited by examiner

MECHANICAL SUPPORT RING FOR ELASTOMER SEAL

CROSS-REFERENCE TO RELATED APPLICATIONS

This application is a National Stage filing of International Application No. PCT/US2016/063363, filed Nov. 22, 2016; which claims the benefit of U.S. Provisional Application No. 62/259,608, filed Nov. 24, 2015.

FIELD

The disclosure relates generally to oilfield tools. The disclosure relates specifically to support for an elastomer seal.

BACKGROUND

Downhole packers are used to isolate portions of wellbores. Downhole packers are tools that are used to form a seal between the outer surface of the production tubing and the casing or wellbore. The packers include ring-shaped elastomer seals that expand against the casing to isolate an area of the wellbore. The seals are compressed to form an annular seal. Elevated pressures can cause the elastomer seals to be pushed out of position. The seals become longitudinally extruded and fail. Longitudinal extrusion can cause the annular seal to be lost and can cause a blowout.

It would be advantageous to have a device and method to prevent extrusion failure of the seals.

SUMMARY

An embodiment of the disclosure is a support ring for an elastomer seal in a packer assembly comprising multiple segments; a back angle; wherein the support ring is expandable. In an embodiment, the support ring comprises 20 segments. In an embodiment, the back angle is 45 degrees. In an embodiment, the support ring interacts with an expander cone. In an embodiment, the expander cone is between the support ring and casing. In an embodiment, the support ring is comprised of steel. In an embodiment, the support ring supports an elastomer seal at 7500 psi.

An embodiment of the disclosure is a method of making the support ring comprising forming a single ring; and cutting the single ring into segments.

An embodiment of the disclosure is a method of supporting an elastomer seal in a packer assembly comprising placing a support ring in a wellbore, wherein the support ring comprises multiple segments; wherein the support ring comprises a back angle running the support ring into the borehole; running the seal into the borehole; expanding the seal; and expanding the support ring. In an embodiment, the support ring comprises 20 segments. In an embodiment, the back angle is 45 degrees. In an embodiment, the support ring interacts with an expander cone. In an embodiment, the expander cone is between the support ring and a push ring. In an embodiment, expanding the support ring occurs due to internal pressure being applied to a packer, a piston compresses the elastomer seal and pushes the support segments up the expander cones and against the casing wall. In an embodiment, a support ring is present at either end of the seal assembly.

An embodiment of the disclosure is a seal assembly comprising at least one center element; at least one element spacer ring; at least one end element; at least one foldback ring; at least one foldback ring retainer; at least one slip retainer; at least one spiral support ring; and at least one expander cone. In an embodiment, the spiral support ring is comprised of 20 segments. In an embodiment, the spiral support ring comprises a back angle. In an embodiment, the back angle is 45 degrees. In an embodiment, the expander cone is between the support ring and a push ring.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

Figure 1:
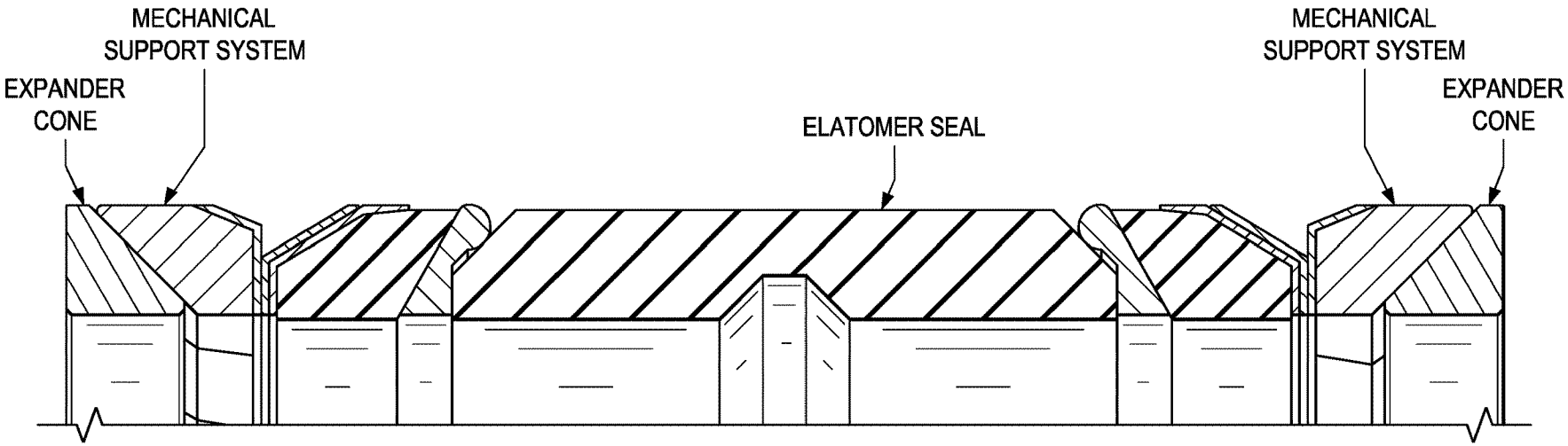
FIG. 1 depicts a side cut-away view of the elastomer seal, support system, and expander cone.
Figure 2A:
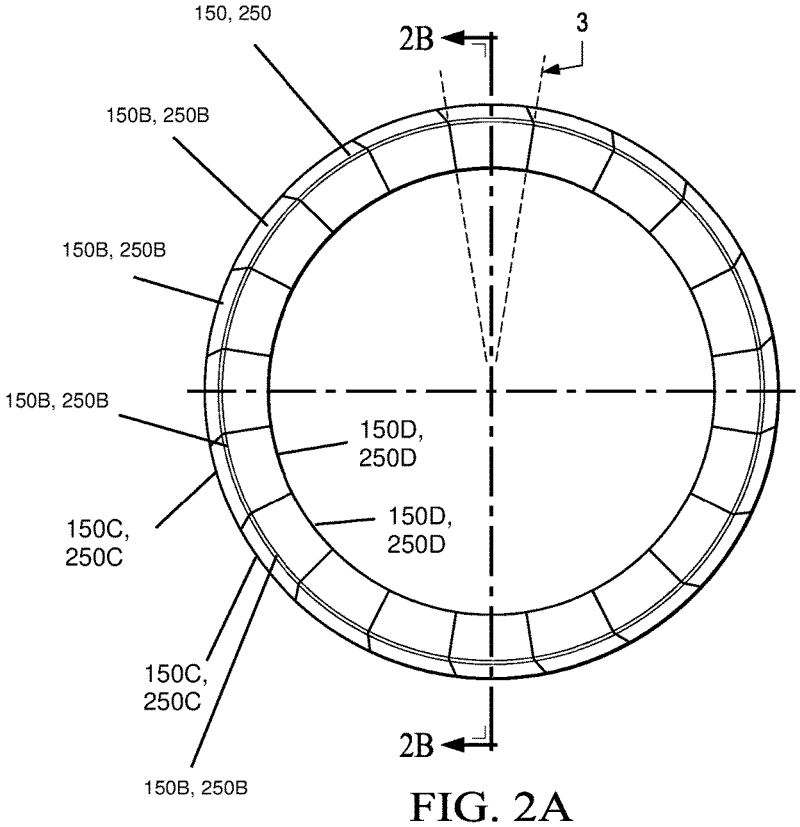
FIG. 2A-2D depicts a spiral support ring without guide A) top view; B) side cross-sectional view; C) side view of section 3 of A; and D) isometric view.
Figure 2B:
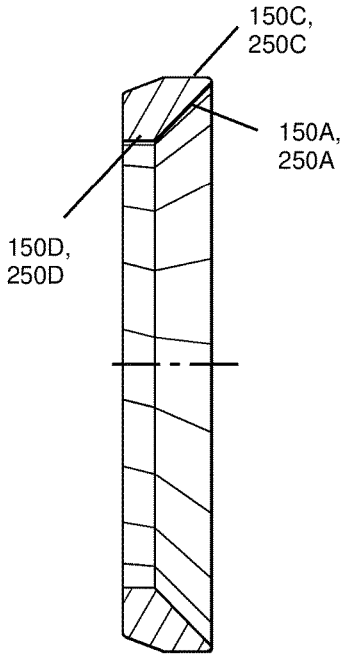
Figure 2C:
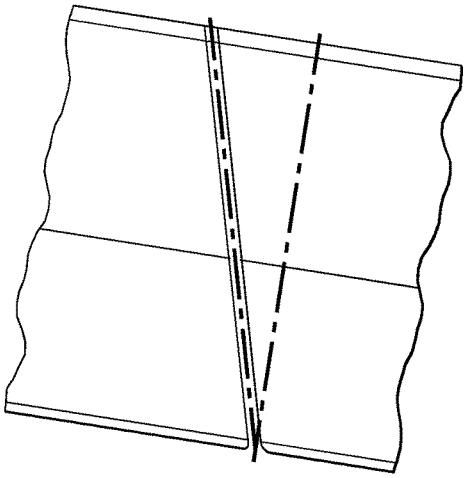
Figure 2D:
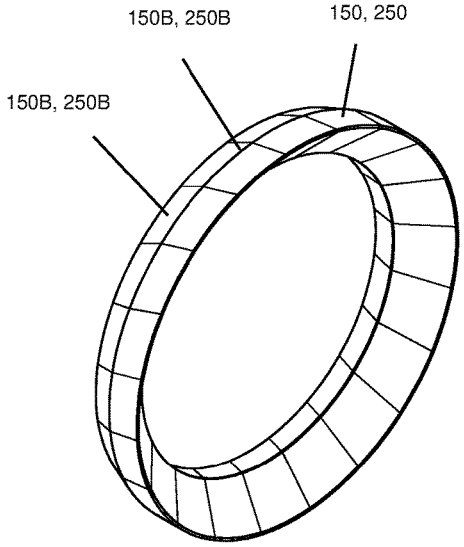

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

As used herein, the term "openhole packer" means and refers to a device used to isolate intervals of the casing or selectively stimulating portions of the wellbore.

Failure analysis performed after testing elastomer seals revealed that elevated pressures were pushing the elastomer seals out of position and causing extrusion failure of the seals.

A mechanical support system can prevent extrusion failure of the seal. The support system needs to be expandable because the system must operate within two configurations. The first configuration for the support system is running into the well. When running into the well, the support system must have a small diameter in order to reduce contact with the borehole wall. The second configuration for the support system is the set position. In the set position, the seal is expanded against the borehole wall. To support the now expanded seal, the support system must also be expanded.

In an embodiment, the seal is comprised of natural rubber. In an embodiment, the support ring is comprised of 4140 steel. In an embodiment, the packer is set hydraulically. In an embodiment, the packer is a swellable packer.

The mechanical support system prevents the elastomer from extruding, allowing the elastomer to seal at high pressures. In an embodiment, the expansion ratio of the mechanical support system is 1.13. The support system can be used in downhole tools that require an elastomeric seal with a high expansion ratio. In an embodiment, the expansion ratio can be any ratio that will allow the mechanical support system to perform its function.

In an embodiment, the foldback ring is slotted radially in 20 places. In an embodiment, the foldback ring can be slotted in any number of places that will allow it to perform its function.

The support ring is part of the packer's seal assembly. There are two support rings per packer. Each support ring is comprised of 20 individual segments and is positioned at either end of the seal assembly. When the correct internal pressure is applied to the packer, a piston compresses the elastomer seal and pushes the support segments up the expander cones and against the casing wall. With the support segments pressed firmly against the casing wall, the segments form a shield which prevents the elastomer element from extruding through to the low pressure zone. In an embodiment, the support ring can be comprised of any number of segments that will allow it to perform its function.

In an embodiment, the support ring comprises a back angle. In an embodiment, the back angle is 45 degrees. In an embodiment, the back angle is greater than 45 degrees and less than or equal to 90 degrees. In an embodiment, the back angle is less than 45 degrees and more than or equal to 0 degrees. In an embodiment, the back angle can be any angle that will allow the support ring to perform its function.

In an embodiment, the expander cone forms a 20 degree inward angle with the casing on a portion of the edge of the expander cone nearest the interior wall of the casing. In an embodiment, the expander cone can form any degree of angle that will allow it to perform its function. In an embodiment, the expander cone can be comprised of any material that will allow it to perform its function.

In an embodiment, the support ring is comprised of 4130/4140 steel. In an embodiment, the support ring is made of 4140 steel. In an embodiment, the support ring is comprised of polyaryletherketone or poly ether ketone. In an embodiment, the support ring is steel. In an embodiment, the support ring can be comprised of any material that will allow it to perform its function.

In an embodiment, the foldback ring retainer is comprised of 4130/4140 steel. In an embodiment, the element spacer ring is comprised of 4130/4140 steel. In an embodiment, the foldback ring is comprised of 1018 steel. In an embodiment, the cone is 4130/4140 steel. In an embodiment, the slip retainer is comprised of 4130/4140. In an embodiment, the foldback ring retainer can be comprised of any material that will allow it to perform its function.

The mechanical support system is made from individual ring segments. The individual segments are cut from a single ring and are easier and cheaper to manufacture than a single piece design. The individual ring segment design also includes a back angle which prevents seal extrusion by blocking the extrusion path of the seal. In an embodiment, the mechanical support system supports an elastomer seal at 7500 psi. In an embodiment, the psi is 10000. In an embodiment, the psi is 5000. In an embodiment, the psi is 2500. In an embodiment, the embodiment, is 1000.

FIG. 1 depicts a side cut-away view of the elastomer seal, support system, and expander cone. Under the correct internal pressure, the support ring segments are pushed up the expander cones and against the casing wall.

FIG. 2A-2D depicts a spiral support ring (first spiral support ring 150, second spiral support ring 250) comprised of 20 segments (first spiral support ring segments 150B with a first spiral support ring collar portion 150D, second spiral support ring segments 250B with a second spiral support ring collar portion 250D). A) top view; B) side cross-sectional view; C) side view of section B-B of A; and D) isometric view. Each segment is 18 degrees of the ring. A portion of the expander cone slants in 20 degrees outwardly away from the first end element on the edge opposite of the support ring. The angle of the edge of the support ring (first spiral support ring slant portion 150A, second spiral support ring slant portion 250A) adjacent to the expander cone is 45 degrees. A portion (first spiral support ring parallel portion 150C, second spiral support ring slant portion 250C) of the support ring is manufactured to be substantially parallel to the interior wall of the casing.

Figure 3A:
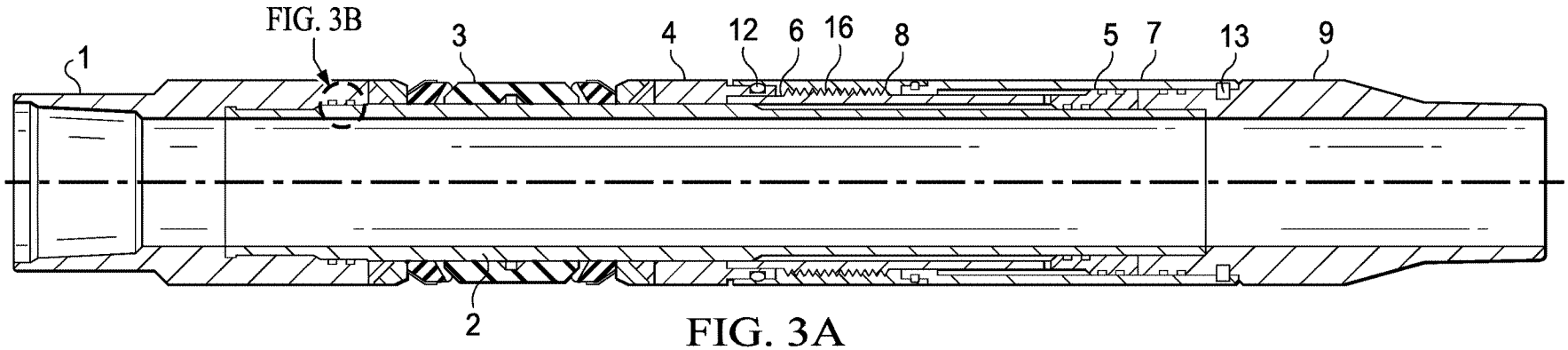
FIG. 3A-3B depicts a A) side cross-sectional view of openhole packer assembly; B) side cross-sectional view of support ring internal at section B.
Figure 3B:
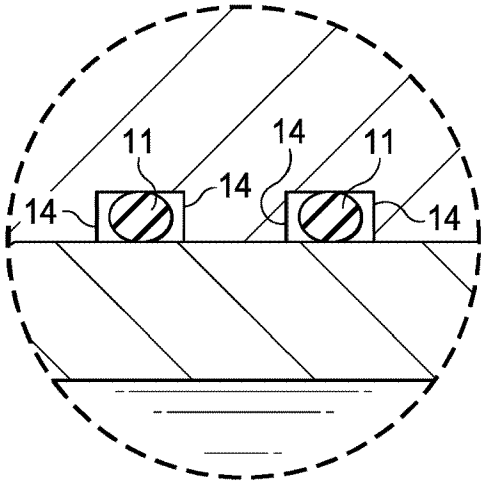

FIG. 3A-3B depicts a A) side cross-sectional view of an openhole packer assembly; B) side cross-sectional view of the support ring internal at section B. The parts of the openhole packer assembly are as follows: 1 top sub; 2 mandrel; 3 seal assembly; 4 push ring; 5 piston; 6 bottom lock ring housing; 7 piston housing; 8 body lock ring; 9 bottom sub; 10 AS568 O-ring; 11 AS568 O-ring; 12 SSFLTSLT; 13 SSCUPSKT; 14 support ring, internal; 15 support ring, external; 16 SSFLTSLT; 17 AS568 O-ring; and 18 support ring, internal.

Figure 4A:
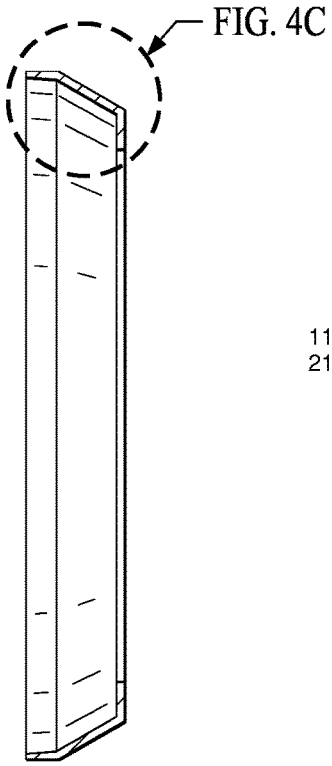
FIG. 4A-4C depicts a foldback ring A) side cross-sectional view; B) isometric view; and C) side cross-sectional view of portion B in A.
Figure 4B:
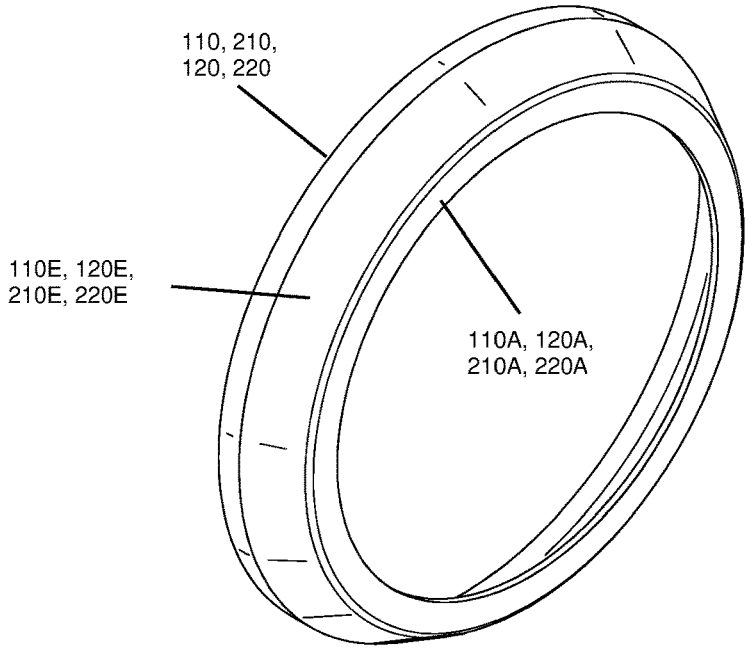
Figure 4C:
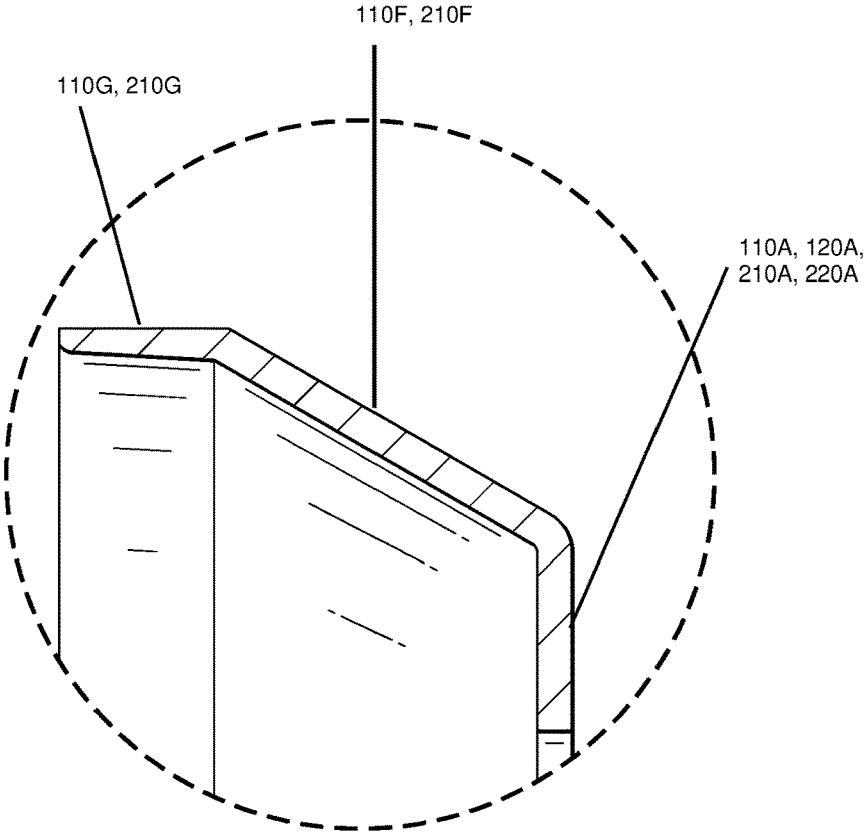

FIG. 4A-4C depicts a foldback ring (a first foldback ring 110, a second foldback ring 210, a first foldback retainer ring 120, a second foldback retainer ring 220) A) side cross-sectional view; B) isometric view; and C) side cross-sectional view of portion B in A. Foldback rings (a first foldback ring 110, a second foldback ring 210, a first foldback retainer ring 120, a second foldback retainer ring 220) are a part of the seal backup system. Foldback rings (a first foldback ring 110, a second foldback ring 210, a first foldback retainer ring 120, a second foldback retainer ring 220) minimize longitudinal extrusion of the seal element. The foldback ring (a first foldback outer segment 110C, a second foldback outer segment 210C, a first foldback outer portion 110F, a second foldback outer portion 210F) comprises a 30 degree angle. A portion (a first foldback thickness change segment 110D, a second foldback thickness change segment 210D, a first foldback thickness change portion 110G, a second foldback thickness change portion 210G) of the foldback ring changes 5 degrees in thickness.

Figure 5A:
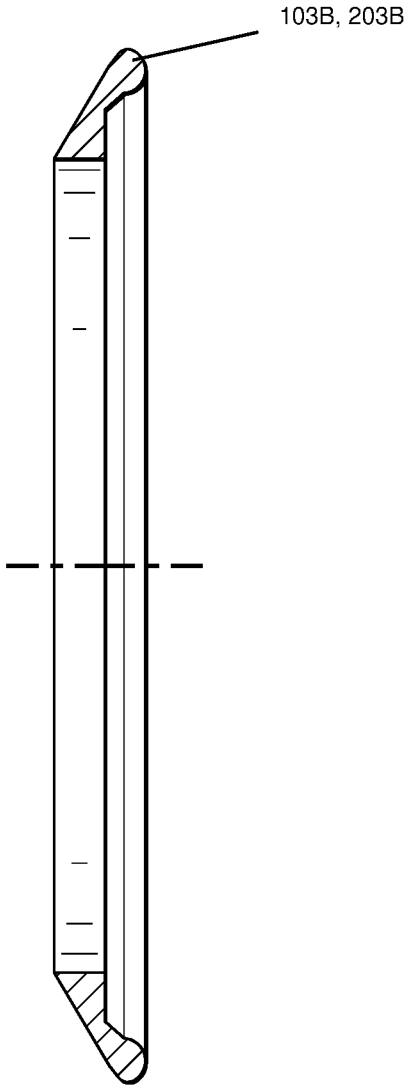
FIG. 5A-5B depicts an element spacer ring A) side cross-sectional view; B) isometric view.
Figure 5B:
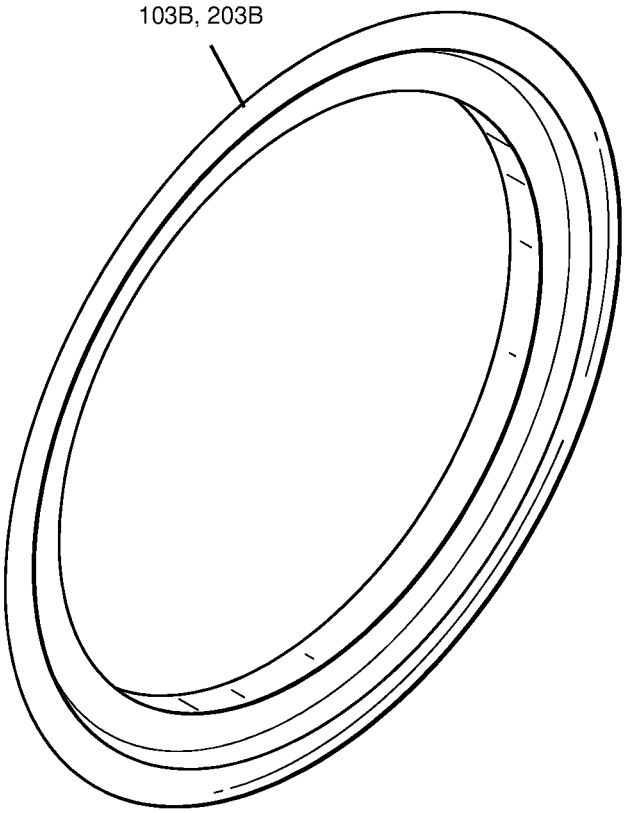
Figure 6A:
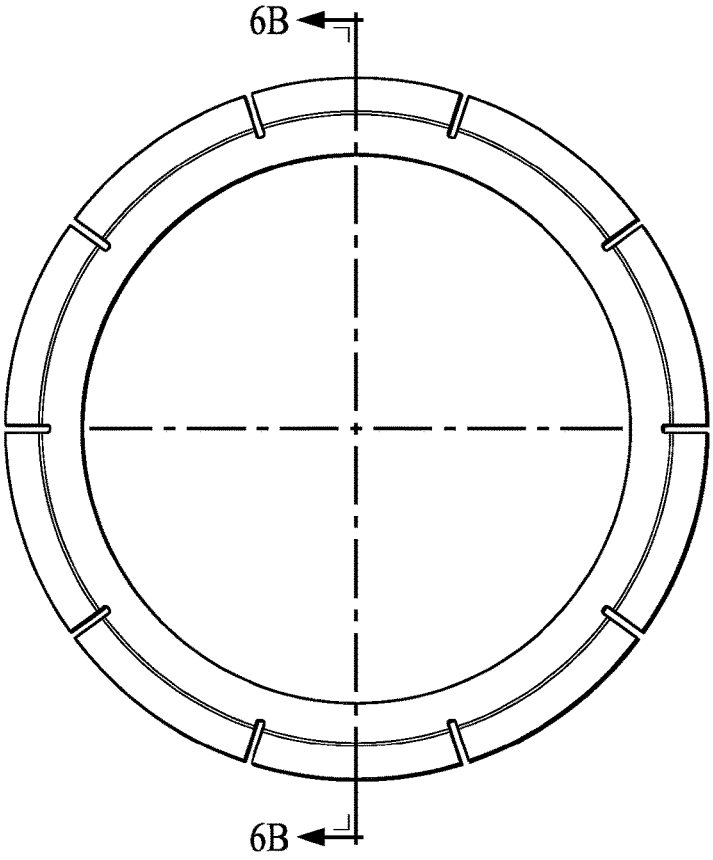
FIG. 6A-6D depicts a foldback ring A) top view; B) side cross-sectional view; C) side cross-sectional view of part B of B; and D) isometric view.
Figure 6B:
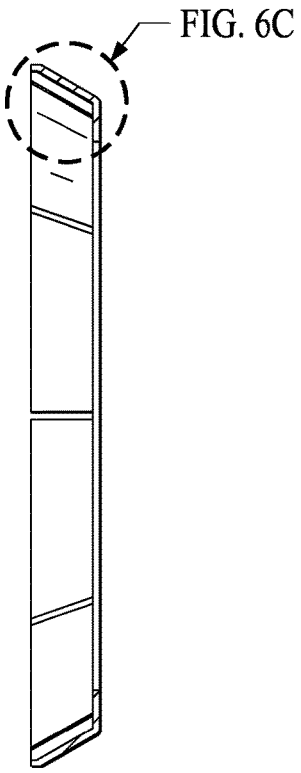
Figure 6C:
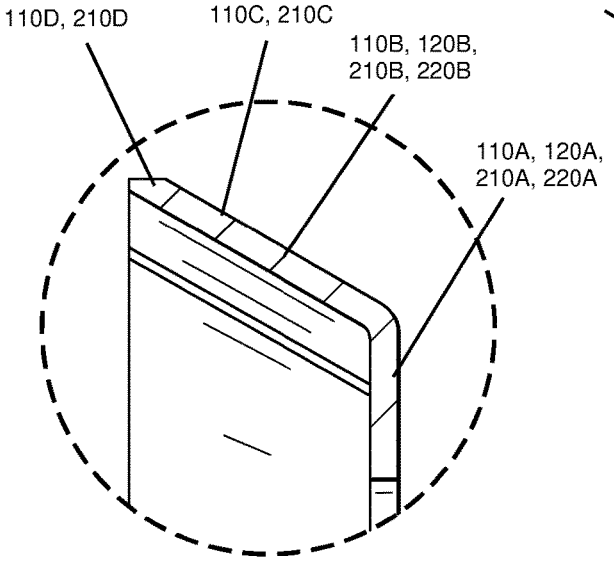
Figure 6D:
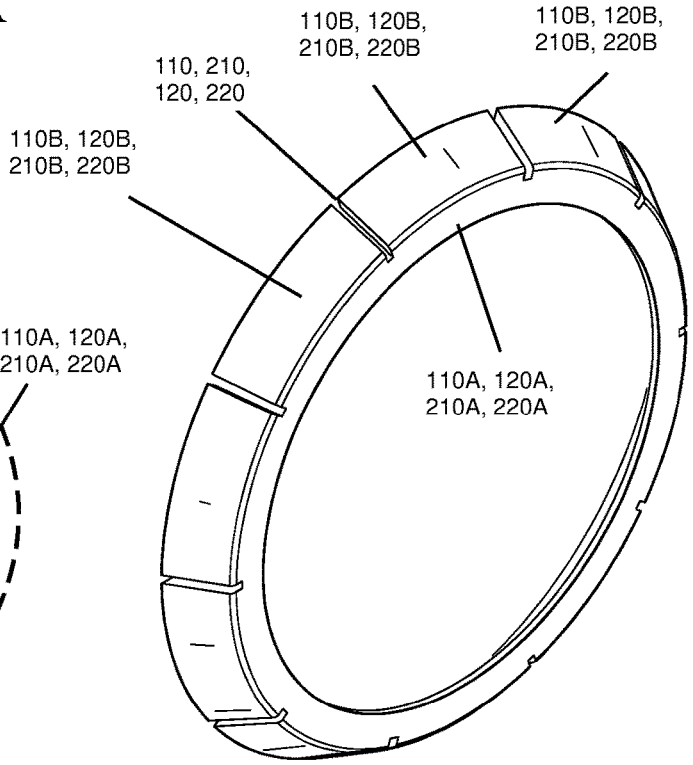
Figure 7A:
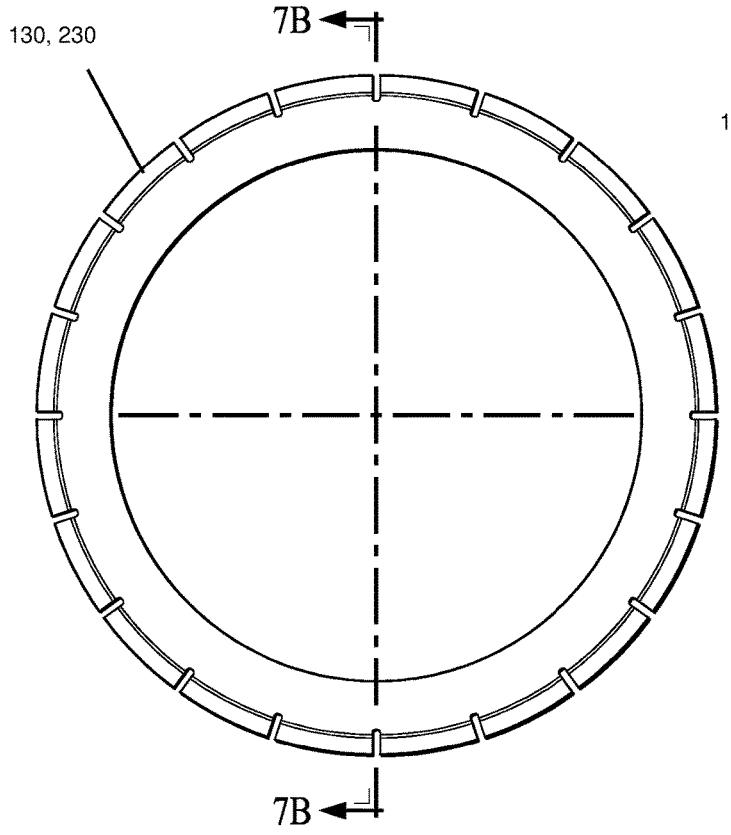
FIG. 7A-7D depicts a slip retainer A) top view; B) side view; C) side view of section B in B; and D) isometric view.
Figure 7B:
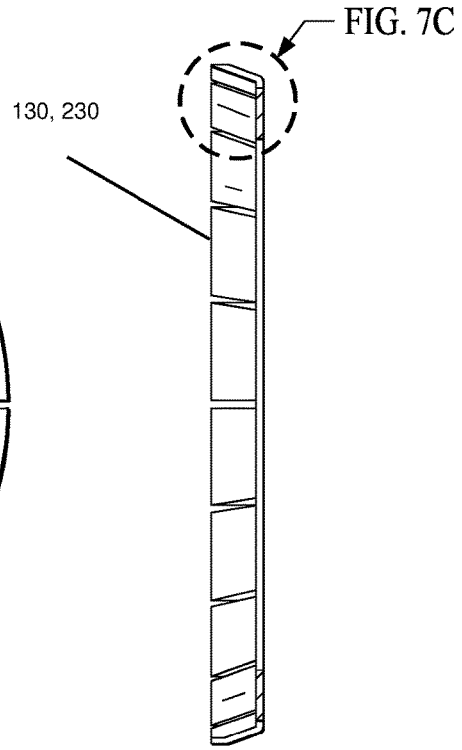
Figure 7C:
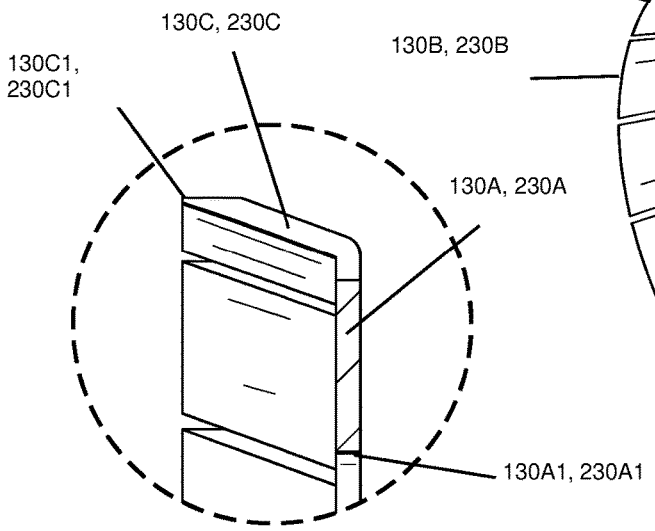
Figure 7D:
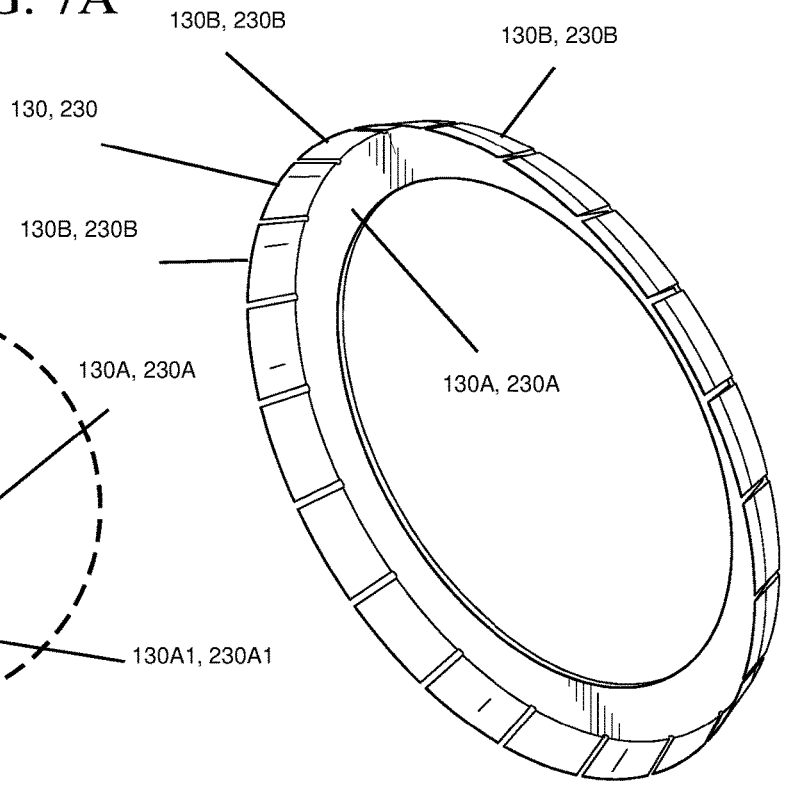

FIG. 5A-5B depicts an element spacer ring A) side cross-sectional view; B) isometric view. The element spacer ring (a first element spacer ring 103B, a second element spacer ring 203B) is adjacent to the end element in the seal assembly.

FIG. 6A-6D depicts a foldback ring A) top view; B) side cross-sectional view; C) side cross-sectional view of part B of B; and D) isometric view. The foldback ring (a first foldback ring 110, a second foldback ring 210, a first foldback retainer ring 120, a second foldback retainer ring 220) has 10 segments (a plurality of first foldback segments 110B, a plurality of first foldback retainer segments 120B, a plurality of second foldback segments 210B, a plurality of second foldback retainer segments 220B, a first foldback portion 110E, a first foldback retainer portion 120E, a second foldback portion 210E, a second foldback retainer portion 220E) of 36 degrees each. The outer portion (a first foldback outer segment 110C, a second foldback outer segment 210C, a first foldback outer portion 110F, a second foldback outer portion 210F) of the foldback ring is angled 30 degrees. The inner portion (a first foldback inner portion 110A, a first foldback retainer inner portion 120A, a second foldback inner portion 210A, a second foldback retainer inner portion 220A) of the ring is comprised of one segment.

FIG. 7A-7D depicts a slip retainer A) top view; B) side cross-sectional view; C) side cross-sectional view of section B in B; and D) isometric view. The slip retainer (first slip retainer 130, second slip retainer 230) is comprised of 20 segments (first slip retainer segment 130B, a second slip retainer segment 230B, first slip inner portion 130A, second slip inner portion 230A) of 18 degrees each. The outer portion (first slip retainer outer portion 130C with a corresponding end 130C1, second slip retainer outer portion 230C with a corresponding end 230C1) of the slip retainer is angled 20 degrees outwardly from the first slip inner portion and away from the first end element. The first slip retainer inner portion 130A (with a corresponding opposite end 130A1, the second slip retainer inner portion 230A with a corresponding opposite end 230A1) extends outwardly past the first foldback inner portion 110A.

Figure 8A:
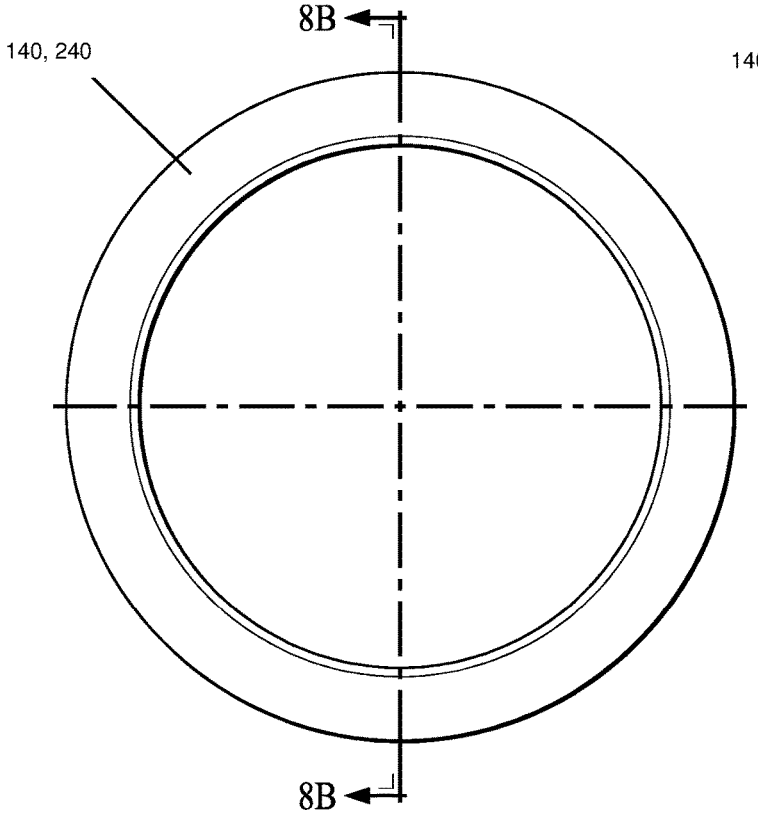
FIG. 8A-8C depicts a cone without guide A) top view; B) side cross-sectional view; and C) isometric view.
Figure 8B:
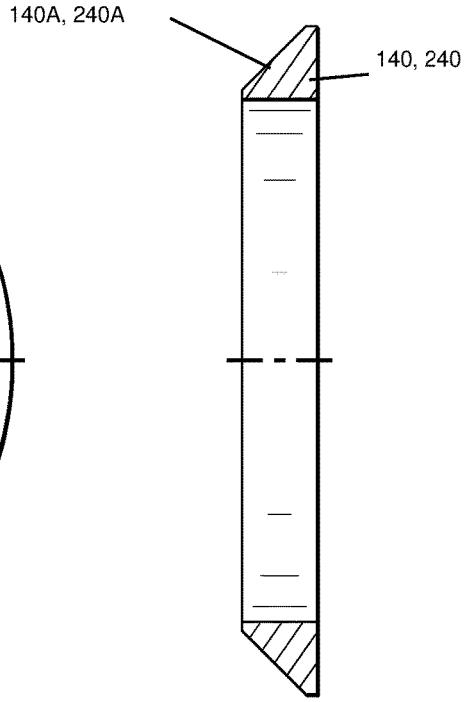
Figure 8C:
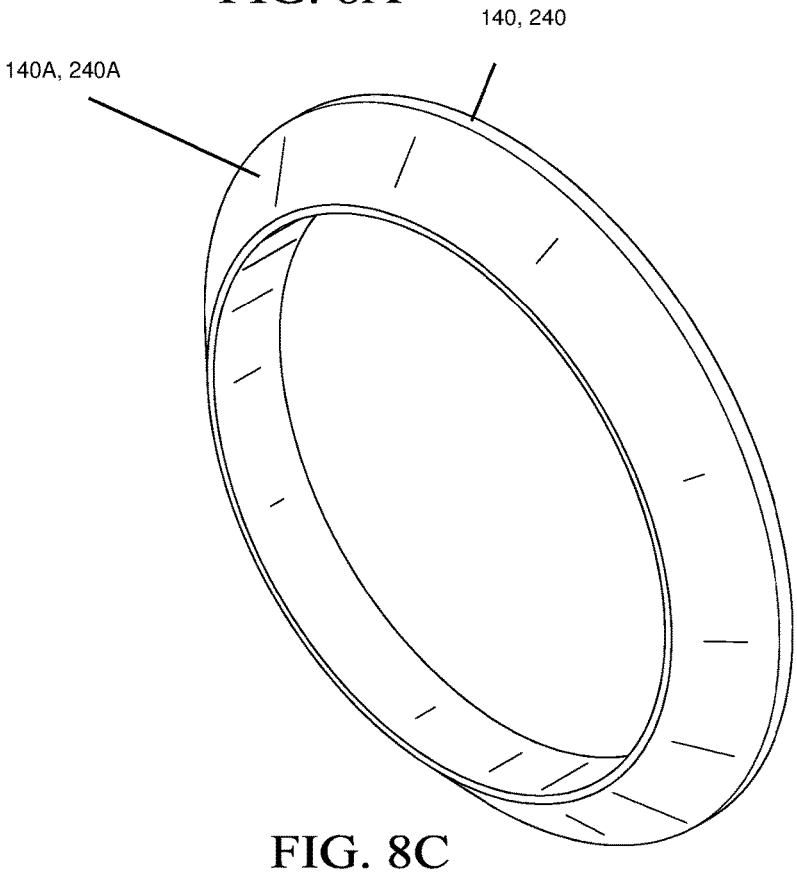

FIG. 8A-8C depicts a cone A) top view; B) side cross-sectional view; and C) isometric view. The cone (first cone element 140, second cone element 240) is angled (first cone end angled section 140A, second cone end angled section 240A) 45 degrees inwardly toward said first end element.

Figure 9A:
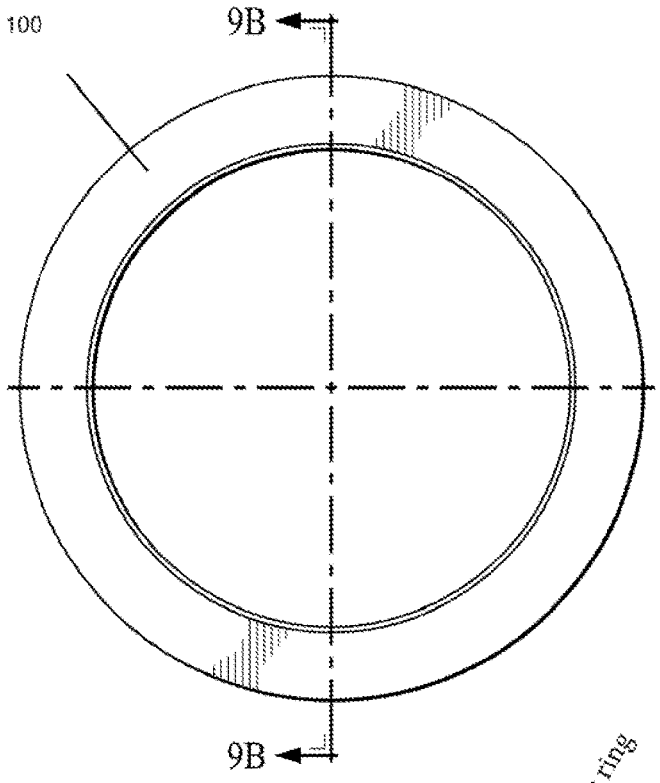
FIG. 9A-9C depicts a seal assembly A) top view; B) side cross-sectional view of section AA of A (Item 1=center element; 2=element spacer ring; 3=end element; 4=foldback ring; 5=foldback ring retainer; 6=cone without guide; 7=spiral support ring without guide; and 8=slip retainer); and C) isometric view.
Figure 9B:
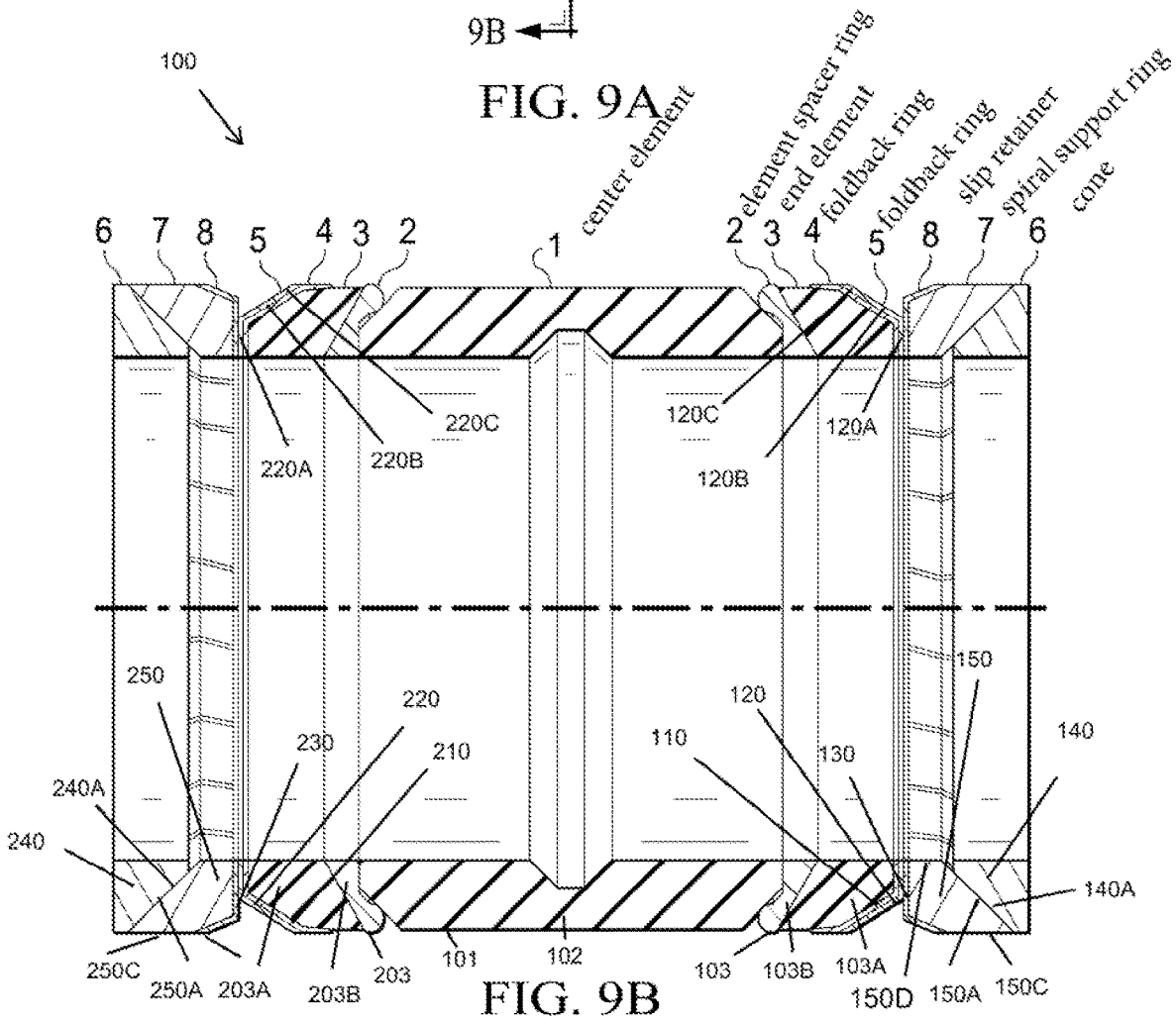
Figure 9C:
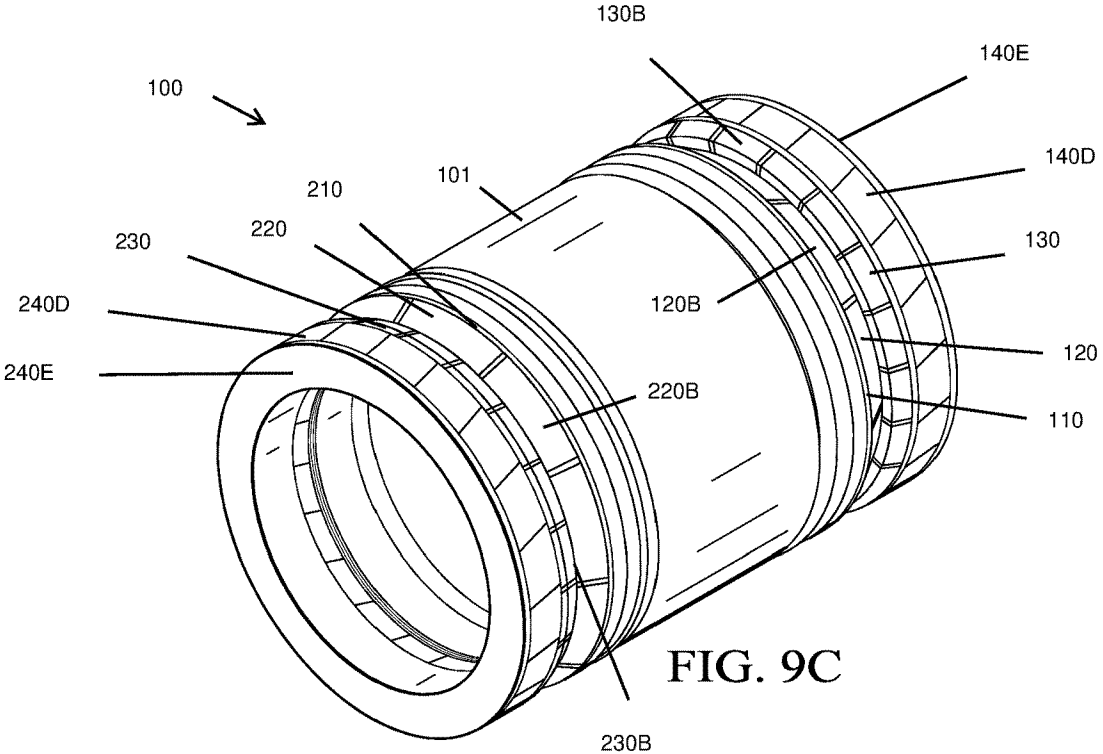

FIG. 9A-9C depicts a seal assembly A) top view; B) side cross-sectional view of section AA of A The parts of the seal assembly are as follows: 1=center element; 2=element spacer ring; 3=end element; 4=foldback ring; 5=foldback ring retainer; 6=cone; 7=spiral support ring; and 8=slip retainer; and C) isometric view of the seal assembly (100) having a seal member 101, a center element 102, a first seal member end 103, a second seal member end 203, a first seal member end 103, a first end element 103A, a second seal member end 203, a second end element 203A, a first element spacer ring 103B, a second element spacer ring 203B, a first foldback ring 110, a second foldback ring 210, a first foldback retainer ring 120, a second foldback retainer ring 220, a first slip retainer 130, second slip retainer 230, a first cone element 140, second cone element 240, first cone end angled section 140A, second cone end angled section 240A, a first spiral support ring 150, second spiral support ring 250, a first spiral support ring slant portion 150A, second spiral support ring slant portion 250A, first spiral support ring parallel portion 150C, and second spiral support ring slant portion 250C.

Figure 10:
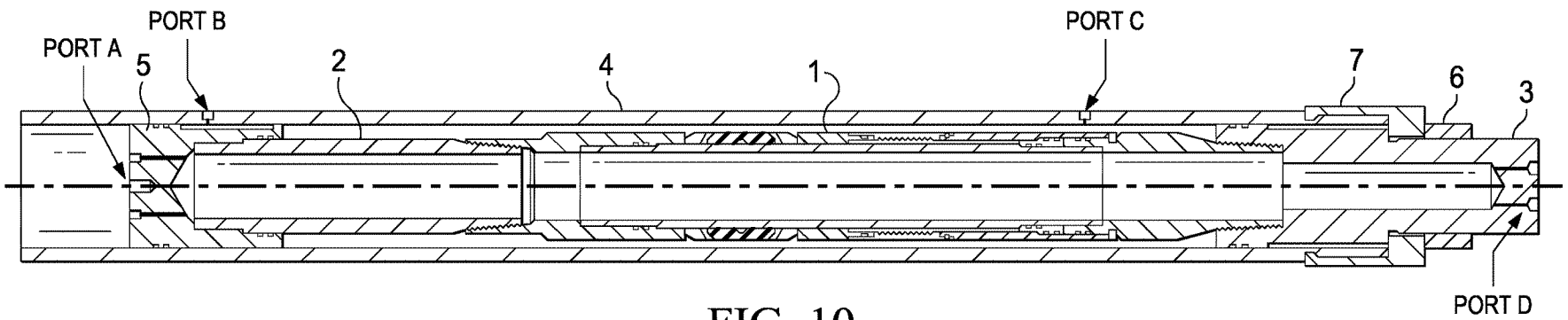
FIG. 10 depicts a side cross-sectional view of an openhole packer test assembly. Ports A (tubing port), B (upper annulus), C (lower annulus), and D (tubing port 2) are a part of the openhole packer test.

FIG. 10 depicts an openhole packer test assembly. Ports A (tubing port), B (upper annulus), C (lower annulus), and D (tubing port 2) are a part of the openhole packer test.

EXAMPLES

Example 1

The objective of this test is to perform an API 11D, V3 qualification test on the openhole packer to 300 degrees Fahrenheit and 7500 PSI. The test will incorporate the seal assembly in FIG. 9. The Center Element and End Elements are from Specialized Seal and Distribution. The seal assembly contains an unguided backup system.

1. Objective. The objective of this test was to perform an API 11D V3 qualification test on the openhole packer. The packer OD was 5.75" and it was set in a casing with an ID of 6.500". The packer was successfully qualified to 7500 psi and 300 degrees Fahrenheit.

2. Measured Parameters and Acceptance Criteria 2.1 The following parameters will be measured during the test The following parameters will be measured during the test: 1) record pressure in Port A (tubing port); 2) record pressure in Port B (upper annulus); 3) record pressure in Port C (lower annulus); 4) record pressure in Port D (tubing port 2); 5) record skin temperature of test casing upper and lower locations; and 6) record internal temperature through Port D.

2.2.1 During each pressure hold period, no more than 1% reduction in the maximum rated differential pressure over the hold period after sufficient time has been allowed for stabilization. Minimum hold period is 15 minutes for pressure tests. Example: For a 10,000 psi hold, the acceptable leak rate is 1% (100 psi) on the differential over 15 minutes.

2.2.2 Pressure Tolerance: −0/+200 PSI 2.2.3 Temperature Tolerance: +/−10 degrees Fahrenheit 2.2.4 Torque Tolerance (During Test Fixture Assembly): +/−500 ft-lbs 3. Procedure 3.1 Test Fixture Setup of Assembly 10010148

3.1.1 Using a torque machine, apply 4400 ft-lbs of right hand torque to the Lower End Cap (PN 10010147) to thread it onto the pin end of the Test Packer (PN 10006190). Note: This connection is a 4-1/2 LTC thread.

3.1.2 Using a torque machine, apply 4400 ft-lbs of right hand torque to the Upper Cross-Over (PN 10009386) to thread it onto the box end of the Test Packer (PN 10006190). Note: This connection is a 4-1/2 LTC thread.

3.1.3 Install the ID O-Rings (PN 10007159) and Support rings (PN 10009485) onto the Upper End Cap (PN 10010146).

3.1.4 Thread the Upper End Cap (PN 10010146) onto the Upper End Crossover (PN 10009386).

3.1.5 Install the O-Rings (PN 10006869) and Back Up Rings (PN 10006322) to the Lower End Cap (PN 10010147)

3.1.6 Install the O-Rings (PN 10006869) only onto the Upper Test Cap (PN 10010146)

3.1.7 Position the Test Casing so that it is upside down and in the vertical position (Note: The pin thread on the Test Casing will be facing upwards)

3.1.8 Support the bottom of the Test Casing so that there is at least a 6" gap between the ground and the bottom (Non-Threaded End) of the Test Casing 3.1.9 With the Test Casing in the vertical position, slide the assembly through the casing with the Upper Test Cap (PN 10010146) going first. Push the assembly until the O-ring grooves on the Upper Test Cap (PN 10010146) are accessible to an individual's hand.

3.1.10 Remove the O-Rings (PN 10006869) on the Upper Test Cap (PN 10010146).

3.1.11 Install new O-Rings and Support rings (PN 10006322) onto the OD of Upper Test Cap (PN 10010146).

3.1.12 Thread the Bottom Cap (PN 10009483) onto the test casing until it shoulders onto the face of casing 3.1.13 Push the test assembly up until the Lower End Cap (PN 10010147) shoulders against the Bottom Cap (PN 10009483)

3.1.14 Screw the Retainer Nut (PN 10009445) onto the Lower End Cap until it shoulders against the Bottom Cap (PN 10009483);

3.1.15 Set up heating gear capable of 300° F.

3.1.16 Set up pressure equipment capable of 10,000 psi 3.1.17 Weld thermal couples to the top and bottom of the casing OD to measure and record the test temperature;

3.1.18 Fill the casing ID and test assembly ID with test fluid. Ensure that all trapped air is removed.

3.2 Pressure Integrity Check on Tubing 3.2.1 Close Port "D". Ports "B" and "C" can be left open.

3.2.2 Apply 1000 PSI pressure to Port "A". Hold for 5 minutes to monitor the leakage. If any leakage detected, tear down the test assembly to check the O-rings and support rings.

3.2.3 Bleed Port "A" to 0 psi 3.3 Pressure Integrity Check on Annulus 3.3.1 Close ports "C", "A" and "D"

3.3.2 Apply 1000 PSI pressure to port "B". Hold for 2 minutes to monitor the leakage. If any leakage detected, tear down the test assembly to check the O-rings and support rings.

3.3.3 Bleed Port "B" to 0 psi 3.4 Heat Up Packer to 300 Fahrenheit 3.4.1 Heat up the assembly to 300° F. and hold for 30-60 minutes for temperature stabilization.

3.5 Setting the Packer (Setting Piston Area is 7.46 inches^2)

3.5.1 Open Ports "B" and "C". Close Port "D"

3.5.2 Apply pressure 500 psi to Port "A". Hold for 2 minutes.

3.5.3 Increase pressure by 500 psi and hold again for 2 minutes.

3.5.4 Repeat previous step until 5500PSI is reached. Hold for 5 minutes at 5500 psi.

3.5.5 Bleed down the pressure from port "A" to 0 psi;

3.5.6 Close all the ports and hold at 300 degrees Fahrenheit for about 30 minutes for temperature stabilization.

3.6 Upper Annulus pressure check (300 Deg. F, 7500 PSI)

3.6.1 Apply pressure in port "B" to 5000PSI and hold for 5 minutes. Monitor the pressure leakage rate;

3.6.2 Bleed down the pressure from Port "C" to 0 psi;

3.6.3 Increase pressure to in Port "B" to 6000PSI and hold for 5 minutes. Monitor the pressure leakage rate;

3.6.4 Increase pressure in Port "B" to 7500PSI and hold for 15 minutes. Monitor the pressure leakage rate;

3.6.5 Bleed down the pressure in Port "B" to 500PSI;

3.7 Lower Annulus pressure check (300 Deg. F, 7500 PSI)

3.7.1 Apply pressure in Port "C" to 5000PSI and hold pressure for 5 minutes. Monitor the pressure leakage rate.

3.7.2 Bleed down the pressure from Port "B" to 0 psi.

3.7.3 Increase pressure in Port "C" to 6000PSI and hold for 5 minutes. Monitor the pressure leakage rate.

3.7.4 Increase pressure in Port "C" to 7500PSI and hold for 15 minutes. Monitor pressure leakage rate.

3.7.5 Bleed down the pressure in port "C" to 500 psi;

3.8 Cool down test piece 3.8.1 Cool down the assembly to 175° F. and hold for 30-60 minutes for temperature stabilization.

3.9 Upper Annulus pressure check (175 Deg. F, 7500 PSI)

3.9.1 Repeat the steps in section 6.6

3.10 Lower Annulus pressure check (175 Deg. F, 7500 PSI)

3.10.1 Repeat the steps in section 6.7

3.11 Heat test piece up 3.11.1 Heat the assembly up to 300° F. and hold for 30-60 minutes for temperature stabilization.

3.12 Upper Annulus pressure check (300 Deg. F, 7500 PSI)

3.12.1 Repeat the steps in section 6.6

3.13 Lower Annulus pressure check (300 Deg. F, 7500 PSI)

3.13.1 Repeat the steps in section 6.7

3.14 Cool down and disassembly 3.14.1 Release all the pressures to zero;

3.14.2 Cool down the test piece to ambient;

3.14.3 Once the assembly is back to ambient, disassemble the tool. The seal assembly used in this test is shown in FIG. 9.

4. Test Report 4.1 Test Summary

The objective of this test was to perform an API 11D V3 qualification test on the openhole packer. The packer OD was 5.75" and it was set in a casing with an ID of 6.500". The packer was successfully qualified to 7500 psi and 300 degrees Fahrenheit.

4.2 Test Setup 4.2.1 Test Caps to Packer Buckup—The Packer Assembly (PN 10006190) has 4.5", 13.5 lb/ft, API end connections per the client's requirement. To get these connections to seal, the packer assembly and Test Caps (PN 10009386 and PN 10009387) were torqued to 4400 ft-lbs. The thread compound used was "Best of Life 2000".

4.2.2 Packer Assembly inside Casing—The packer in two pieces. The packer assembly was bucked up to its two Test Caps. The O-rings and support rings were installed onto the Test Caps and pushed into the test casing (PN 10009899) via a fork truck.

4.3 Hydro Static Test Results

After assembly, the annulus and tubing zones were checked with 250 psi and held for five minutes at ambient temperature. These holds were successful.

Figure 11:
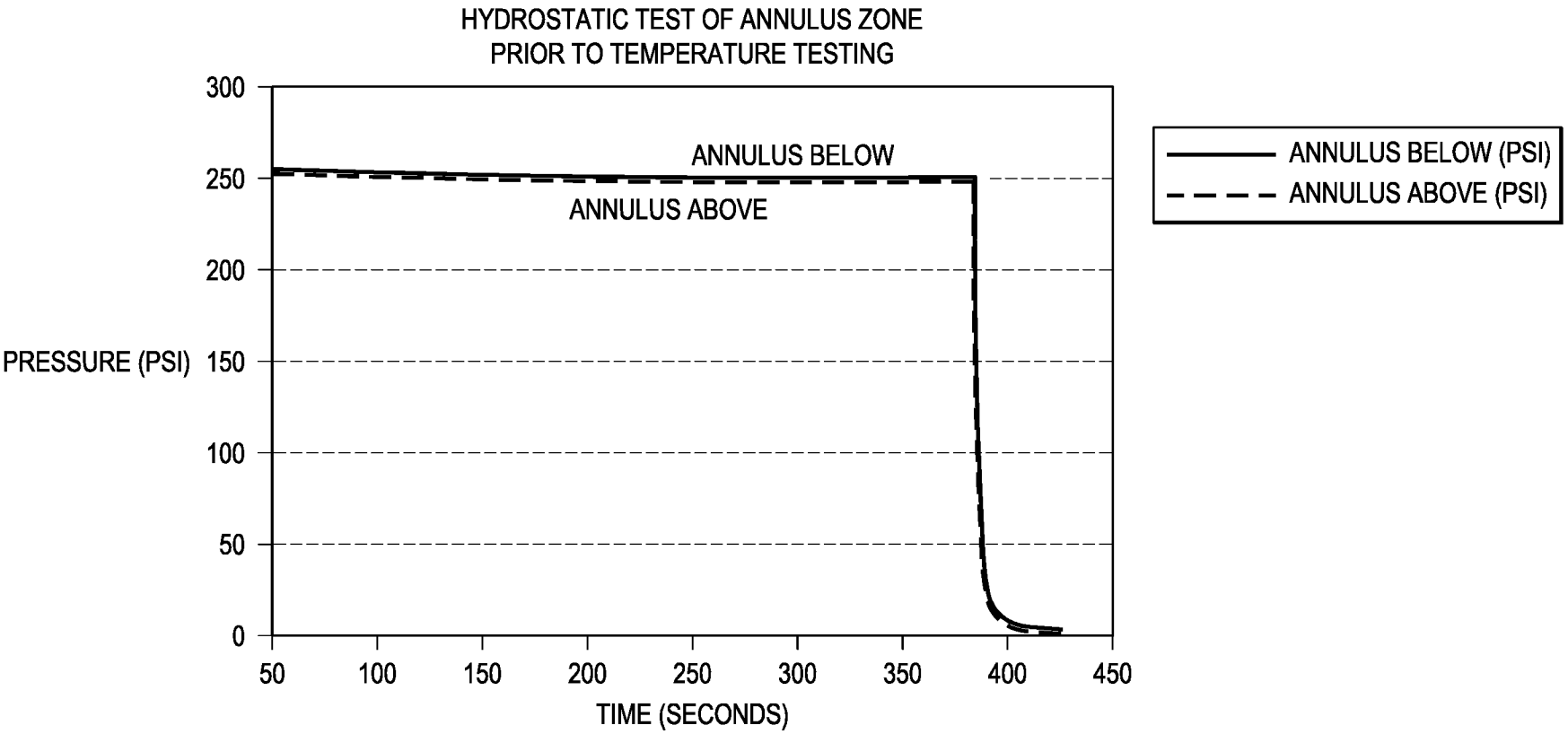
FIG. 11 depicts a hydrostatic test of annulus zone prior to temperature testing.

FIG. 11 depicts a hydrostatic test of annulus zone prior to temperature testing. The annulus below and annulus above held the pressure over time.

Figure 12:
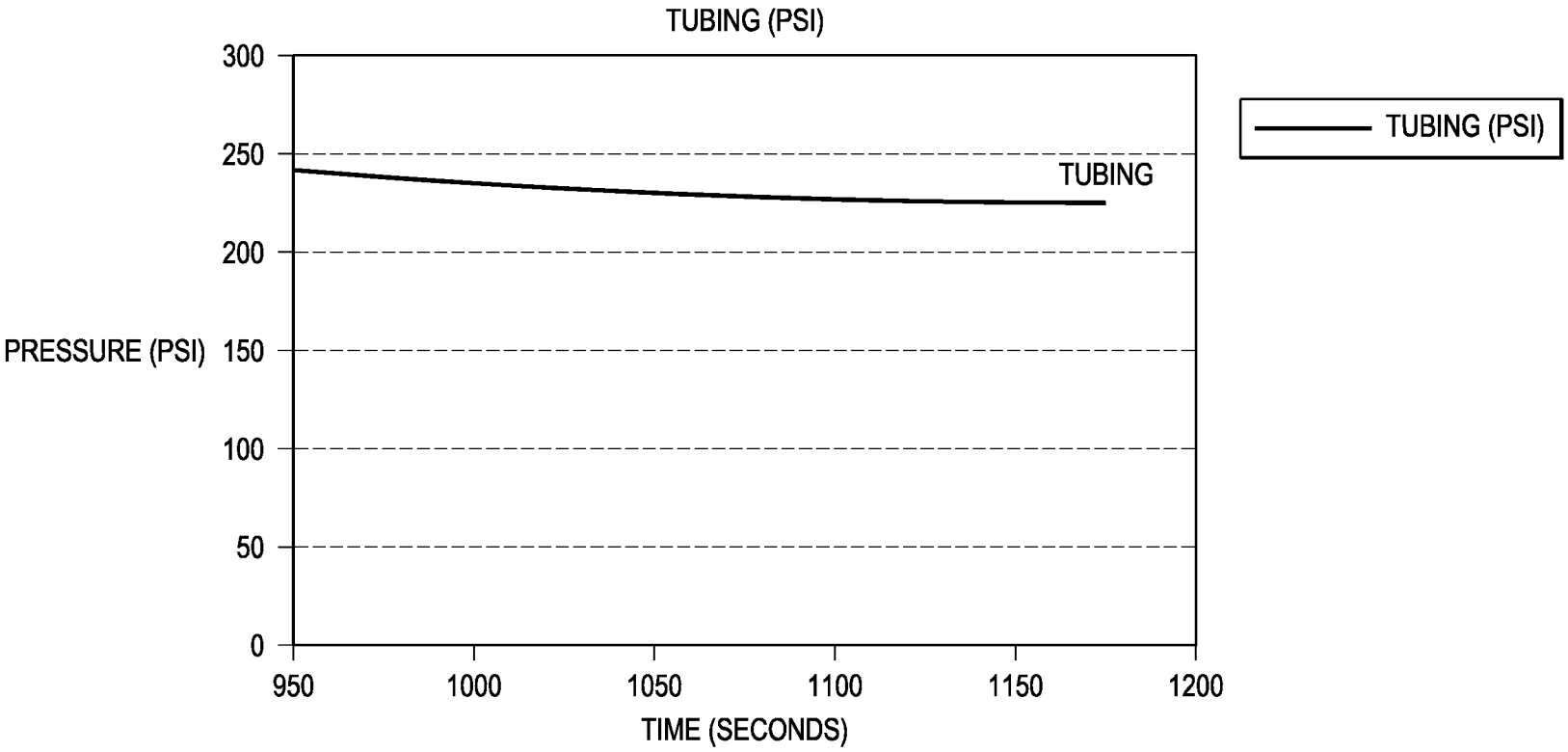
FIG. 12 depicts a graph of the PSI of the tubing over time.

FIG. 12 depicts a graph of the PSI of the tubing over time. The pressure of the tubing only decreased slightly over time.

Figure 13:
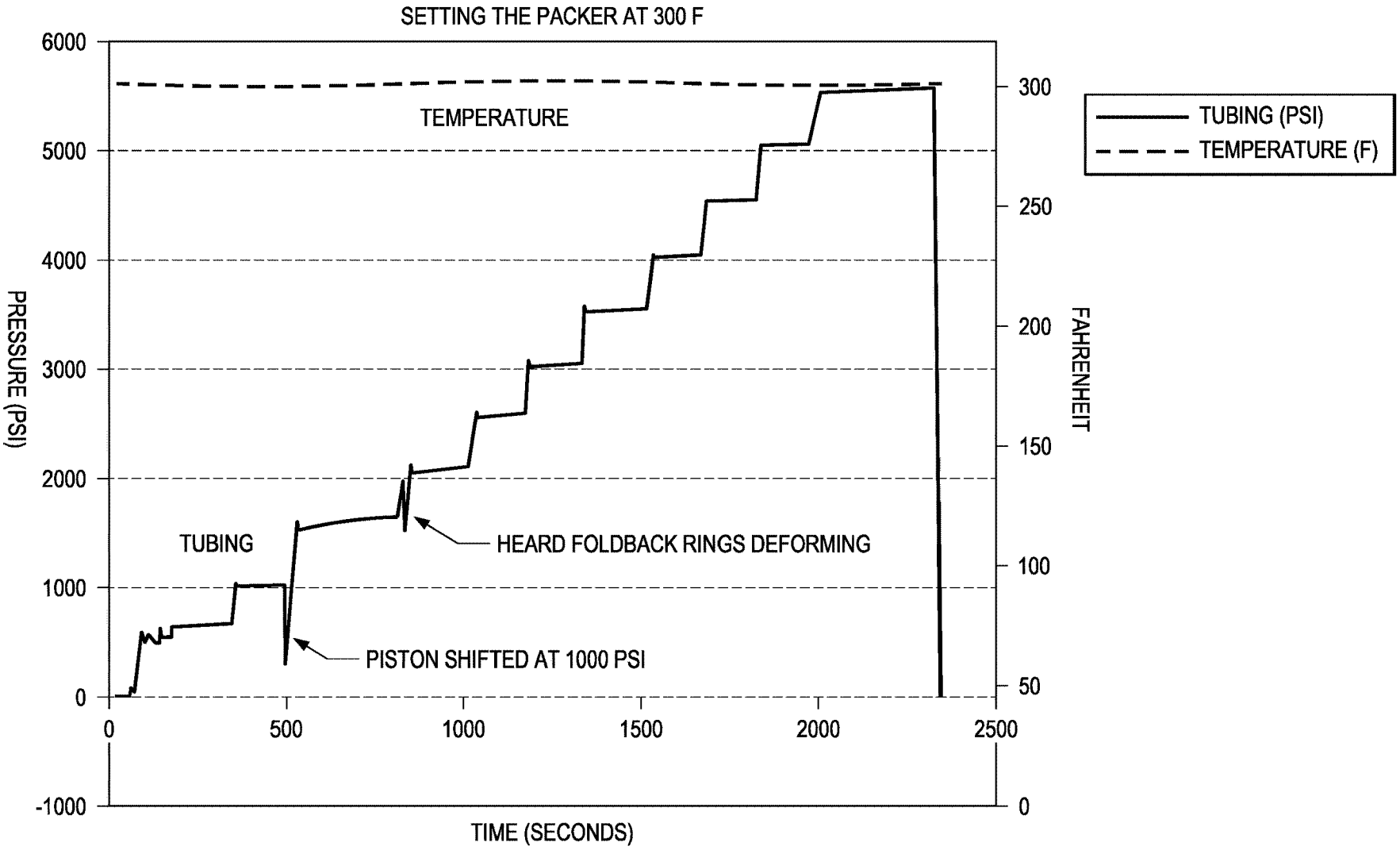
FIG. 13 depicts a graph of setting the packer at 300° F.

4.4 Packer Setting Results 4.4.1 The packer was set with 5,500 psi in 500 psi increments. The shear pins sheared at approximately 1000 psi. The Foldback Rings (PN 10010009) folded back at around 1750-2000 psi. Both of these events left clear pressure signatures. There was also an audible sound of the Foldback Rings (PN 10010009) deforming which indicated that the packer seal element was being set. FIG. 13 depicts the graph of setting the packer at 300° F.

4.4.2 The Packer Piston (PN 10006185) stroked approximately 3.125-3.250" during setting of the seal element. This distance was measured after the packer was removed from the Test Casing.

Figure 14:
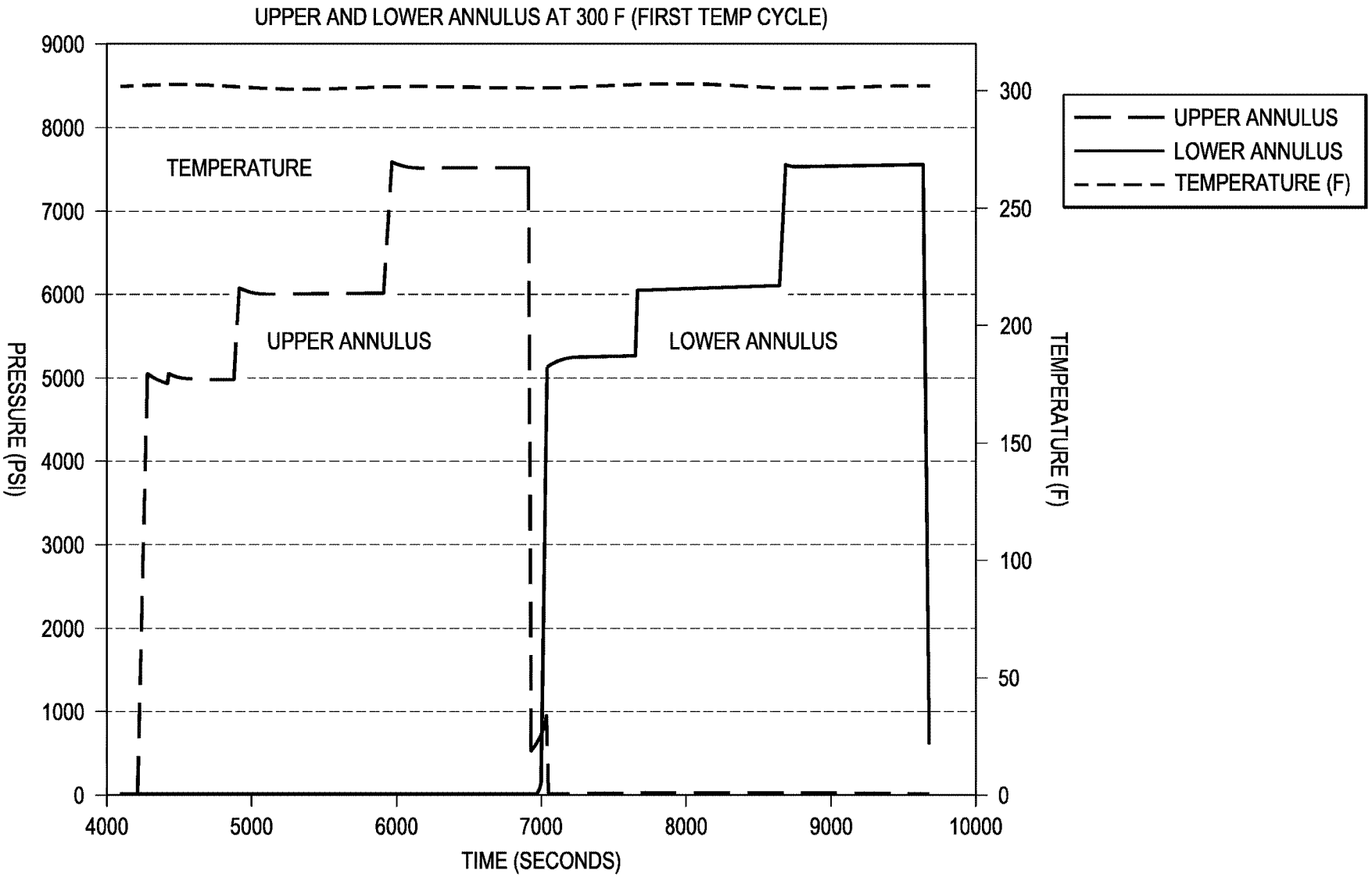
FIG. 14 depicts a graph of the upper and lower annulus at 300° F. (First Temperature Cycle).

4.5 Upper and Lower Annulus Holds at 300 Degrees Testing 4.5.1 The packer passed all pressure hold periods. Each hold had under 75 psi of pressure drop during the 15 minutes after stabilization. FIG. 14 depicts a graph of the upper and lower annulus at 300° F. (First Temperature Cycle).

Figure 15:
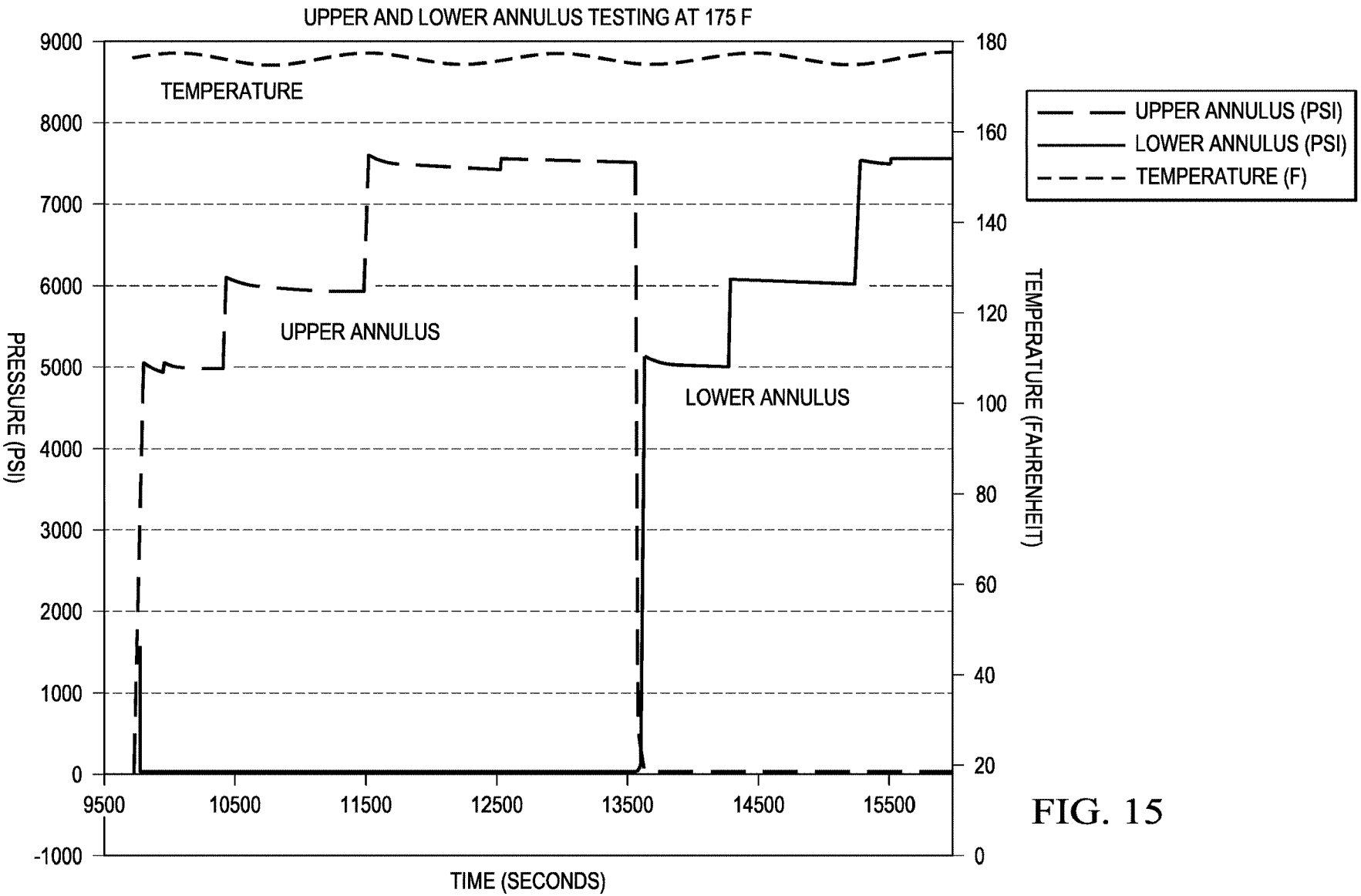
FIG. 15 depicts a graph of the upper and lower annulus at 175° F.

4.6 175 Degree Temperature Testing Results 4.6.1 The packer passed all pressure hold periods. Each hold had under 75 psi of pressure drop during the 15 minutes after stabilization. FIG. 15 depicts a graph of the upper and lower annulus at 175° F.

Figure 16:
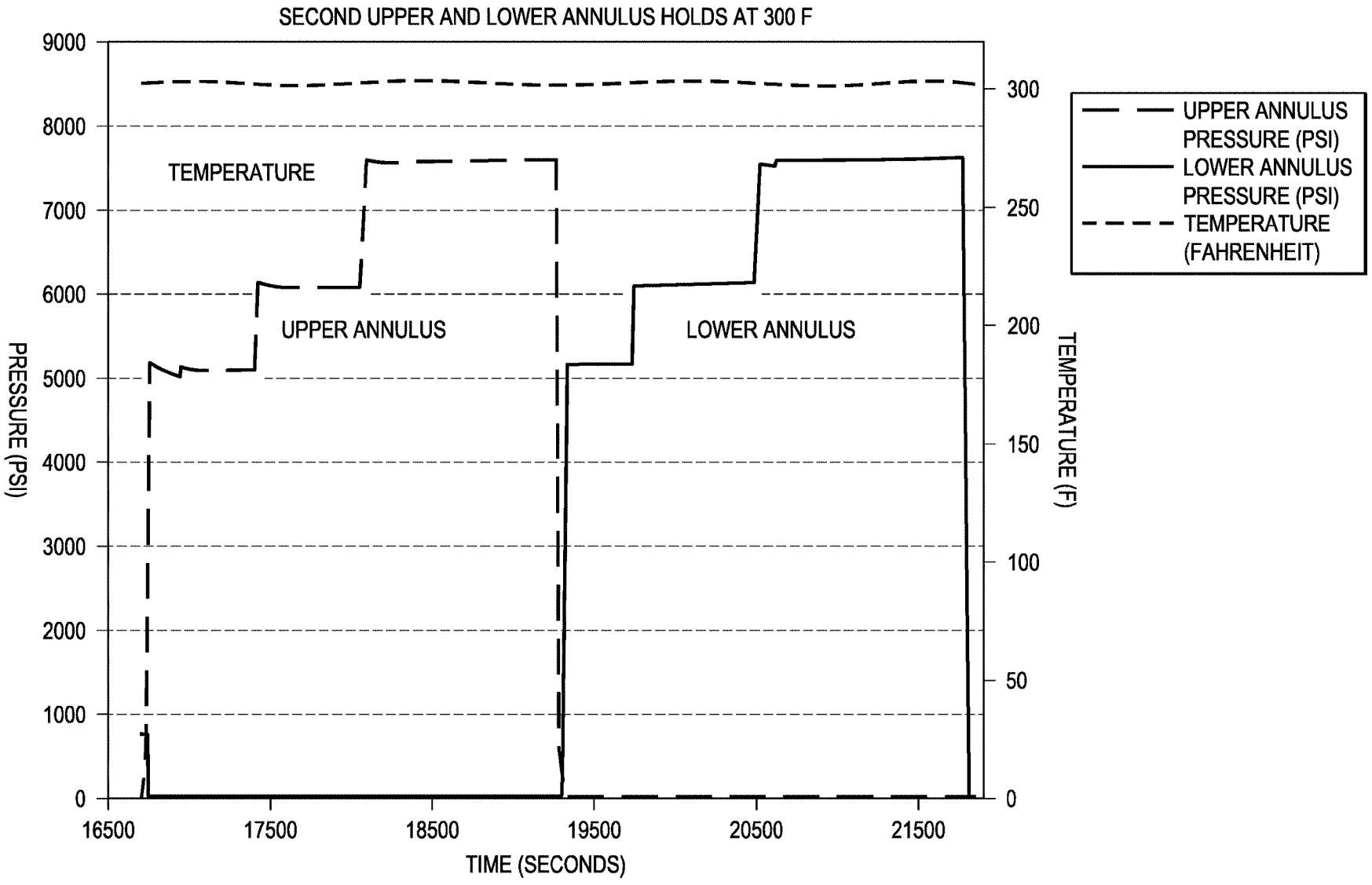
FIG. 16 depicts a graph of the second upper and lower annulus holds at 300° F.

4.7 Second Round of 300 Degree F. Temperature Testing Results 4.7.1 The packer passed all pressure hold periods. Each hold had under 75 psi of pressure drop during the 15 minutes after stabilization. FIG. 16 depicts a graph of the second upper and lower annulus holds at 300° F.

4.8 Removing the Packer from the Test Fixture 4.8.1 The packer could not be removed from Test Casing with a fork truck. The packer test fixture was removed via an overhead crane. The force to pull the packer assembly from the Test Casing was approximately 5000 lbs.

4.10 Conclusions and Lessons Learned 4.10.1 The packer successfully passed all pressure holds at both 300 degrees F. and 175 degrees F.

4.10.2 Installation of the packer assembly into the Test Casing was achieved with a forklift as opposed to a rubber mallet or other human effort.

4.10.3 The packer was set with 5500 psi. However, all piston movement and noise ended at approximately 2500 psi. Perhaps during another qualification test, a lower setting pressure could be attempted.

4.10.4 The Packer Piston (PN 10006185) stroked approximately 3.125-3.250" during setting of the seal element.

4.10.5 Removal of the packer required the use of an overhead crane. Human effort or a forklift were not used to remove the packer from the Test Casing.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A seal assembly configured to be positioned around a mandrel of an open hole packer, the seal assembly comprising:

a seal member having a center element, a first seal member end on one side of the center element and a second seal member end opposite said first seal member end;

a first foldback ring, wherein said first seal member end is between said center element and said first foldback ring, wherein the first foldback ring being comprised of a first foldback inner portion and a first foldback portion, and wherein said first foldback portion is angled outwardly toward the first seal member end from said first foldback inner portion;

a first slip retainer being comprised of a first slip retainer inner portion, and a first slip retainer outer portion, said first slip retainer outer portion being comprised of a plurality of first slip retainer segments, wherein the first slip retainer segments are angled outwardly from said first slip inner portion and away from said first seal member end, wherein each first slip retainer outer portion is angled outwardly from said first slip inner portion and away from said first seal member end, and wherein the first slip retainer inner portion extends outwardly past the first foldback inner portion so as to prevent bending deformation of the first foldback inner portion away from said sealing member;

wherein the first slip retainer inner portion and the first slip retainer outer portion are shorter in length than the first foldback inner portion and the first foldback portion so as to prevent extrusion of said sealing member;

a first spiral support ring being comprised of a plurality of first spiral support ring segments, each first spiral support ring segment having a first spiral support ring slant portion, a first spiral support ring parallel portion, and a first spiral support ring collar portion, wherein each first spiral support ring segment has an initial configuration with each first spiral support ring parallel portion coplanar with a corresponding end of a respective first slip retainer outer portion and each first spiral support ring collar portion adjacent to a corresponding opposite end of a respective first slip retainer inner portion so as to be configured to support said first foldback ring against extrusion of said sealing member by extension of each first spiral support ring parallel portion concurrent with the corresponding end of the respective first slip retainer outer portion, wherein each first spiral support ring slant portion is angled outwardly away from the first seal member end, and wherein said first slip retainer is between said first spiral support ring and said first foldback ring; and a first cone element having a first cone end angled section in sliding engagement to said first spiral support ring slant portion, wherein said first cone end angled section is angled inwardly toward the first seal member end.

2. The seal assembly, according to claim 1, wherein the first seal member end is comprised of a first end element and a first element spacer ring between the center element.

3. The seal assembly, according to claim 1, wherein said first foldback portion is comprised of a first foldback outer portion and a first foldback thickness change portion.

4. The seal assembly, according to claim 1, wherein said first foldback portion is comprised of a plurality of first foldback segments.

5. The seal assembly, according to claim 4, wherein each first foldback segment is comprised of a first foldback outer segment and a first foldback thickness change segment.

6. The seal assembly, according to claim 1, further comprising:

a first foldback retainer ring adjacent to the first foldback ring, the first foldback ring being between the first seal member end and the first foldback retainer ring, wherein the first foldback retainer ring being comprised of a first foldback retainer inner portion and a first foldback retainer portion, and wherein said first foldback retainer portion is angled outwardly toward the first seal member end from said first foldback retainer inner portion.

7. The seal assembly, according to claim 6, wherein said first foldback retainer ring is comprised of another first foldback ring.

8. The seal assembly, according to claim 6, wherein said first foldback retainer portion is comprised of a plurality of first foldback retainer segments.

9. The seal assembly, according to claim 1, further comprising:

a second foldback ring, wherein said second seal member end is between said center element and said second foldback ring, wherein said second foldback ring being comprised of a second foldback inner portion and a second foldback portion, wherein said second foldback portion is angled outwardly toward the second end element from said second foldback inner portion, and wherein said second foldback ring is a mirror image of said first foldback ring;

a second slip retainer being comprised of a second slip retainer inner portion, and a second slip retainer outer portion, said second slip retainer outer portion being comprised of a plurality of second slip retainer segments, wherein the second slip retainer segments are angled outwardly from said second slip inner portion and away from said second seal member end, wherein each second slip retainer outer portion is angled outwardly from said second slip inner portion and away from said second seal member end, wherein the second slip retainer inner portion extends outwardly past the second foldback inner portion so as to prevent deformation of the second foldback inner portion bent away from said sealing member, and wherein the second slip retainer inner portion and the second slip retainer outer portion are shorter in length than the second foldback inner portion and the second foldback portion so as to prevent extrusion of said sealing member;

a second spiral support ring being comprised of a plurality of second spiral support ring segments, each second spiral support ring segment having a second spiral support ring slant portion, a second spiral support ring parallel portion, and a second spiral support ring collar portion, wherein each second spiral support ring segment has an initial configuration with each second spiral support ring parallel portion coplanar with a corresponding end of a respective second slip retainer outer portion and each second spiral support ring collar portion adjacent to a corresponding opposite end of a respective second slip retainer inner portion so as to be configured to support said second foldback ring against extrusion of said sealing member by extension of each second spiral support ring parallel portion concurrent with the corresponding end of the respective second slip retainer outer portion, wherein each second spiral support ring slant portion is angled outwardly away from said second seal member end, and wherein said second slip retainer is between said second spiral support ring and said second foldback ring; and a second cone element having a second cone end angled section in sliding engagement to said second spiral support ring slant portion, wherein said second cone end angled section is angled inwardly toward said second seal member end.

10. The seal assembly, according to claim 9, wherein the second seal member end is comprised of a second end element and a second element spacer ring between the center element.

11. The seal assembly, according to claim 9, wherein said second foldback portion is comprised of a second foldback outer portion and a second foldback thickness change portion.

12. The seal assembly, according to claim 9, wherein said second foldback portion is comprised of a plurality of second foldback segments.

13. The seal assembly, according to claim 12, wherein each second foldback segment is comprised of a second foldback outer segment and a second foldback thickness change segment.

14. The seal assembly, according to claim 9, further comprising:

a second foldback retainer ring adjacent to the second foldback ring, the second foldback ring being between said second seal member end and the second foldback retainer ring, wherein the second foldback retainer ring being comprised of a second foldback retainer inner portion and a second foldback retainer portion, and wherein said second foldback retainer portion is angled outwardly toward said second seal member end from said second foldback retainer inner portion.

15. The seal assembly, according to claim 14, wherein said second foldback retainer ring is comprised of another second foldback ring.

16. The seal assembly, according to claim 14, wherein said second foldback retainer portion is comprised of a plurality of second foldback retainer segments.

* * * * *